United States Patent [19]

Erickson et al.

[11] 4,183,713

[45] Jan. 15, 1980

[54] PITOT PUMP WITH JET PUMP OPERATED THRUST BALANCE

[75] Inventors: John W. Erickson, Huntington Beach; Francis B. Brown, La Crescenta, both of Calif.

[73] Assignee: Kobe, Inc., Huntington Park, Calif.

[21] Appl. No.: 867,711

[22] Filed: Jan. 9, 1978

Related U.S. Application Data

[62] Division of Ser. No. 632,403, Nov. 17, 1975, abandoned.

[51] Int. Cl.[2] ..... F04D 1/14

[52] U.S. Cl. ..... 415/89; 415/104; 417/80

[58] Field of Search ..... 415/88, 89, 104, 106; 417/79, 80, 83, 84, 87, 89

[56] References Cited

U.S. PATENT DOCUMENTS

| | | | |
|---|---|---|---|
| 1,722,289 | 7/1929 | Gurley | 415/89 |
| 3,004,495 | 10/1961 | Macklis | 415/89 |
| 3,795,457 | 3/1974 | Erickson et al. | 415/89 |
| 3,817,659 | 6/1974 | Erickson et al. | 415/89 |
| 3,822,102 | 7/1974 | Erickson et al. | 415/89 |

*Primary Examiner*—Louis J. Casaregola
*Attorney, Agent, or Firm*—Christie, Parker & Hale

[57] ABSTRACT

This pitot pump is provided with pressure balancing for minimizing thrust loads on its bearings. The pump has a housing containing a rotatable casing mounted on a shaft. A fixed pitot tube is mounted in the casing for withdrawing pressurized fluid as the casing rotates and discharging the fluid through an axial outlet passage extending through one end wall of the casing. Fluid is introduced to the casing through the same end wall by way of an annular inlet passage coaxial with the outlet passage. The fluid flows from this inlet passage to the interior of the casing through a plurality of radiating passages in the end wall of the casing. When such a pump is used with a pressurized inlet fluid, an axial thrust on the casing bearings would result if it were not for the thrust balancing means. This comprises an axial balancing chamber between a portion of the end wall opposite the fluid inlet and a portion of the pitot tube. The interior of this chamber is in fluid communication with the suction inlet of a jet pump. Pressurized fluid from the pitot pump is applied to the jet inlet of the jet pump and the outlet of the jet pump is connected to the inlet to the pitot pump. Thus, pressure in the balancing chamber is reduced for minimizing axial thrust and any fluid entering the chamber from the interior of the casing is repressurized and returned to the pitot pump inlet.

10 Claims, 4 Drawing Figures

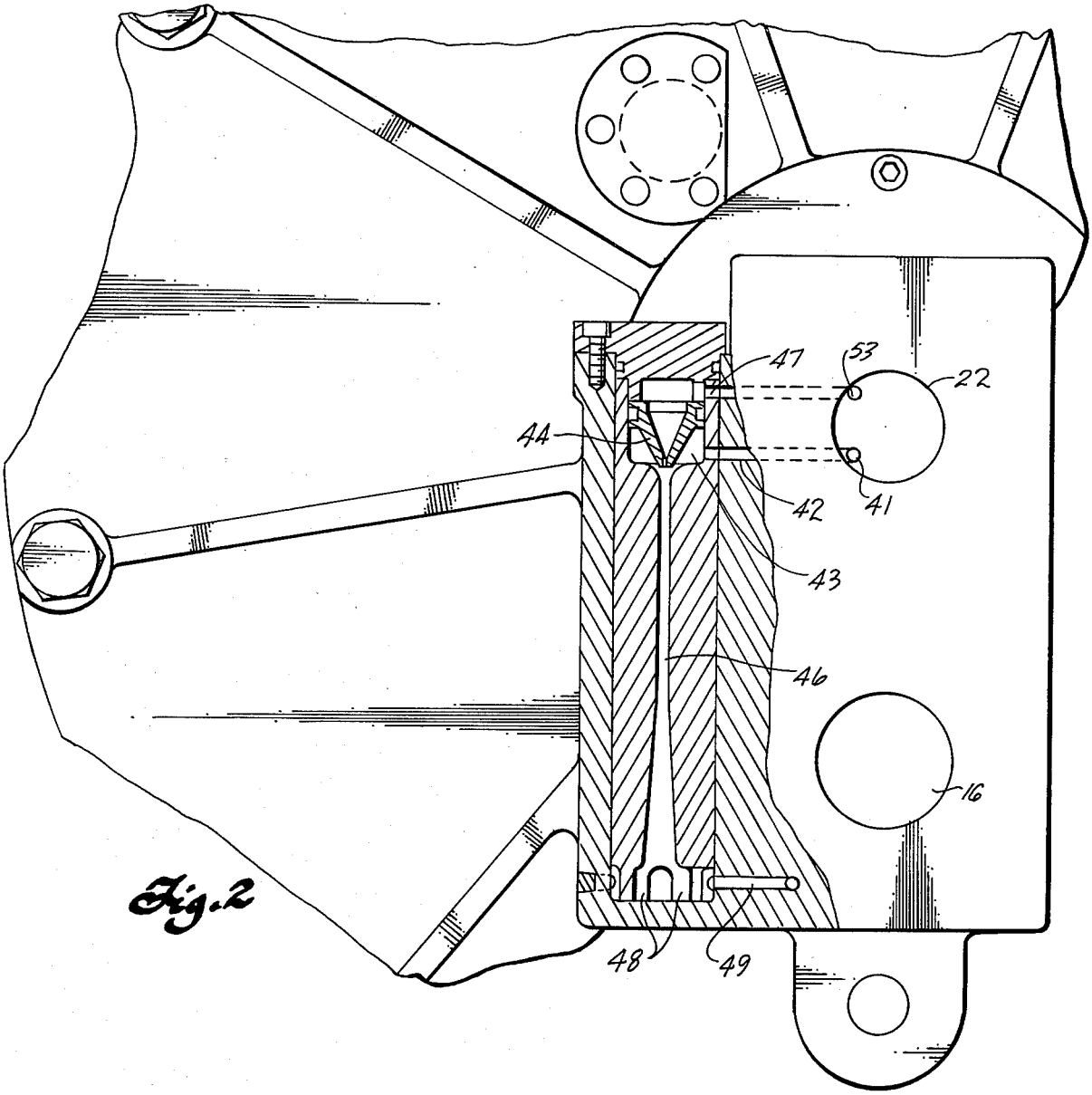
Fig. 2
Fig. 3
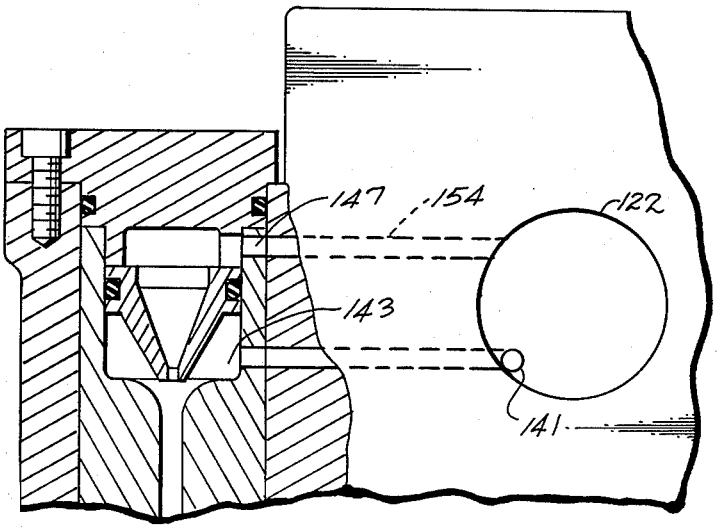

PITOT PUMP WITH JET PUMP OPERATED THRUST BALANCE

CROSS REFERENCE TO RELATED APPLICATIONS

This is a division of application Ser. No. 632,403, filed Nov. 17, 1975, now abandoned.

BACKGROUND

U.S. Pat. No. 3,817,659 assigned to Kobe, Inc., assignee of this application, describes a pitot pump having many features in common with this development. Broadly, such a pitot pump has a fixed housing within which is mounted a rotatable casing. A fixed pitot tube is mounted in the casing for withdrawing fluid from near the periphery of the casing as it rotates. This results in high pressure fluid that is discharged through an axial passage through an end wall of the rotatable casing. Fluid is introduced to the interior of the casing through an annular passage surrounding the pitot pump outlet and then through a plurality of radiating passages in the end wall of the casing. Such pumps operate for long periods at high efficiency.

A pitot pump of this type may operate with approximately ambient pressure at the fluid inlet. When this is the case there is no significant axial thrust by the casing on the bearings on which it is mounted. The pitot pump described in U.S. Pat. No. 3,817,659 includes a jet pump connected to the pump inlet to increase the net positive suction head for enhancing the pitot pump discharge. Other means may also be employed for pressurizing the pitot pump, such as, for example, operation in an essentially closed system wherein the inlet pressure may be a few hundred psi. During such operation, there is a net thrust load on the casing corresponding to the pressure of the inlet fluid and the area of the inlet passage. Except for this area, pressure forces induced by the fluid balance out to have no net thrust.

U.S. Pat. No. 3,822,102 provides a means for balancing the thrust load in a multi-stage pitot pump. This is done by providing an axial chamber at the opposite end of the rotatable casing from the fluid inlet. The interior of this balancing chamber is in fluid communication, by way of a tube, with the inlet passage to the pump. This essentially balances the areas on which pressure acts, thereby minimizing axial thrust.

Such an arrangement is suitable for a multi-stage pitot pump where the pressure to be balanced is present due to pressure differential between the stages. It is not appropriate for a single-stage pitot pump having a pressurized fluid inlet. It is therefore desirable to provide means for minimizing the thrust load on the bearings supporting the rotatable casing of a pitot pump for use with pressurized inlet fluid.

BRIEF SUMMARY OF THE INVENTION

There is, therefore, provided in practice of this invention, according to a presently preferred embodiment, an improvement in a pitot pump having a rotatable casing mounted on bearings, a fixed pitot tube in the casing for withdrawing pressurized fluid and discharging it through one end wall of the casing, and an annular inlet passage coaxial with the outlet passage for introducing fluid to the casing. The improvement comprises balancing means for minimizing axial thrust on the bearings during operation of the pitot pump with pressurized inlet fluid. The balancing means is in the form of an axial chamber defined by an end wall of the casing and an end of the pitot tube, both opposite the end wall through which the inlet and outlet passages extend. A rotary seal is provided between the fixed and rotatable parts of the chamber to minimize leakage of fluid from within the casing. A fluid conduit connects the balancing chamber with the suction inlet of a jet pump. Means are provided for applying pressurized fluid to the jet inlet of the jet pump and the outlet of the jet pump is connected to the inlet of the pitot pump for discharging fluid from the balancing chamber into the pressurized inlet fluid.

DRAWINGS

These and other features and advantages of the present invention will be appreciated as the same becomes better understood by reference to the following detailed description of a presently preferred embodiment when considered in connection with the accompanying drawings wherein:

FIG. 2 is a partial transverse cross-section of the pitot pump of FIG. 1;

FIG. 3 is a fragmentary cross-section similar to FIG. 2 illustrating another embodiment.

DESCRIPTION

Figure 1:
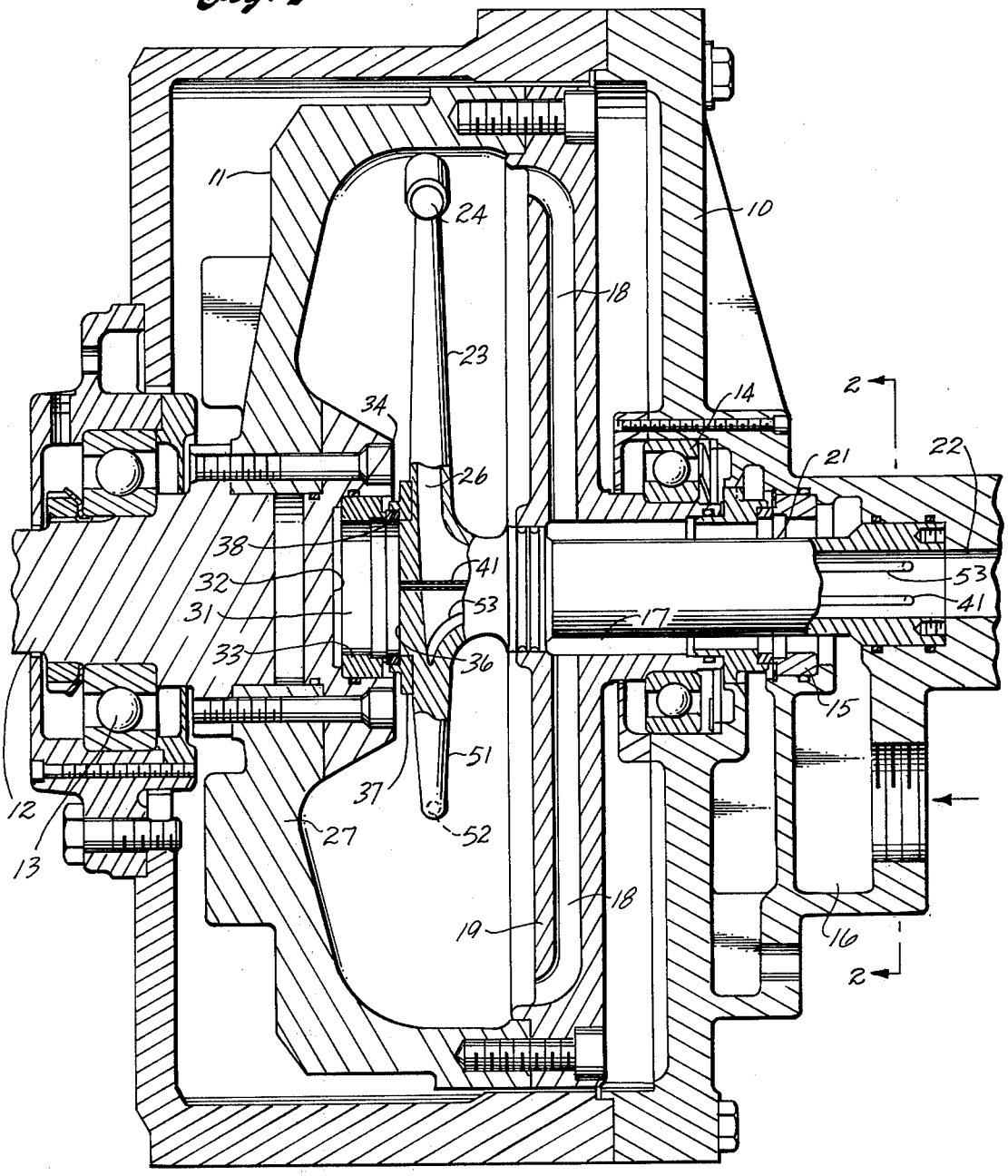
FIG. 1 is a longitudinal cross-section of a pitot pump constructed according to principles of this invention.

FIG. 1 illustrates in longitudinal cross-section a pitot pump, many details of which are conventional and similar to those provided in the above-mentioned U.S. Pat. No. 3,817,659. The pump has a housing 10 generally in the form of a short cylinder. A rotatable casing 11 is mounted in the housing on a shaft 12 which can be connected to a prime mover such as an electric motor. A ball bearing 13 supports the shaft in the housing at one end of the casing. Another ball bearing 14 supports the opposite end of the casing in the housing. The ball bearings 13 and 14 are ordinarily arranged to carry primarily radial loads without substantial axial loading. Appreciable axial loading on the bearings may result in excessive wear and premature failure.

A conventional carbon seal assembly 15 or the like provides a rotating seal between the end portion of the casing 11 and the housing, thereby minimizing fluid leakage.

Fluid is introduced to the pitot pump through an inlet chamber 16. The fluid then flows along an annular inlet passage 17, part of which is defined by the stationary housing and part by the rotating casing. Fluid flows through the passage to the inlet ends of a plurality of radiating passages 18 in one end wall 19 of the casing. The radial passages 18 carry the fluid to near the periphery of the rotatable casing and discharge into its interior.

A rigid tube 21 is connected to the housing at the opposite end from the shaft 12 on which the rotatable casing is mounted. The tube 21 extends through the annular inlet passage 17, thereby providing an axial outlet passage 22. A fixed pitot tube 23 is on the end of the rigid inlet tube 22 and mounted so that its inlet port 24 is near the periphery of the casing. Thus as the casing rotates, fluid therein is caused to rotate and a portion of the high velocity fluid is withdrawn by the inlet of the pitot tube. This fluid passes along a generally radial passage 26 for discharge through the axial outlet passage 22 and the velocity head at the inlet is converted to pressure head in the pitot tube. This much of the pitot pump will be apparent to one skilled in the art.

If it were not for practice of this invention, the pressurized inlet fluid would act on the full face of one end wall 27 of the casing and on the opposite end wall 19. There would be an unbalance proportional to the mean area subtended by the seal 15 tending to force the casing 11 towards the left as illustrated in FIG. 1. The resulting thrust on the bearings could lead to premature failure. With a fluid inlet pressure of, say, 400 psig, the axial thrust load can be rather high. In a typical embodiment of pitot pump the mean seal area is about six square inches giving a thrust force of about 2400 pounds.

An axial balancing chamber 31 is provided with a diameter corresponding to the diameter of the fluid seal 15. Means are provided for maintaining the balancing chamber 31 at substantially ambient pressure for minimizing thrust loading on the casing. One end wall 32 of the balancing chamber 31 is defined by a portion of the end wall 27 of the rotatable casing 11. A seal ring 33 is mounted in the casing and sealed thereto by an O-ring 34. The opposite end of the balancing chamber 31 is defined by an axial end portion 36 of the pitot tube opposite from the inlet and outlet passages. A seal ring 37 bolted to the pitot tube supports a fluorocarbon seal 38 in engagement with the seal ring 33 on the end wall of the casing. It is not essential that the seal 38 be completely free of leakage since any fluid leaking from the interior of the casing 11 into the balancing chamber 31 is discharged as the pressure in the chamber is kept near ambient.

A conduit 41 extends through the end wall 36 of the pitot tube to make fluid communication with the interior of the balancing chamber 31. This conduit extends along the inlet passage 22 to a portion remote from the casing where it passes through a sidewall of the rigid inlet tube 21. As best seen in FIG. 2, the conduit 41 from the chamber connects to a passage 42 leading to the suction inlet 43 of a jet pump. The jet pump has a jet nozzle 44 aligned with a diffuser passage 46. Pressurized fluid from a jet inlet 47 passes through the nozzle 44, thereby creating a suction at the suction inlet 43 and drawing fluid from the balancing chamber 31 (FIG. 1). The jet pump thereby significantly reduces the pressure in the axial balancing chamber. The jet fluid and any fluid withdrawn from the axial chamber mix in the diffuser passage 46 and are discharged from the jet pump through a spider 48 into an outlet passage 49. The mixed fluids discharge into the inlet to the pitot pump, preferably into the inlet chamber 16 (FIG. 1).

Pressurized fluid for operating the jet pump is obtained from the interior of the casing. In the preferred arrangement an auxiliary pitot tube 51 is mounted on the rigid outlet tube 21. This secondary pitot tube is integral with the first mentioned pitot tube 23 and approximately diametrically opposite. Its opening 52 faces in the same rotational direction as the opening 24 in the primary pitot tube 23. The auxiliary pitot tube 51 is located at a radial distance in the casing much nearer the center of rotation. Because of this the circumferential velocity of fluid in the casing is appreciably lower than it is near the periphery and the pressure generated in the secondary pitot tube is appreciably less than the primary outlet pressure of the pump. A tube 53 carries fluid from the auxiliary pitot tube to the jet inlet 47 of the jet pump. Thus, the fluid for powering the jet is withdrawn from the rotatable casing and after withdrawing fluid from the balancing chamber 31, is reinjected into the pitot pump inlet.

The aforementioned U.S. Pat. No. 3,817,659 points out advantages of employing pressurized fluid from a pitot tube nearer the axis of rotation than the primary pitot tube of the present pitot pump. The reason generally lies in the lower pressure applied to the jet pump with consequent reductions in cavitation and other operating problems.

In a situation where the inlet to the pitot pump is pressurized, these problems become less significant and it is sometimes feasible to obtain the pressurizing fluid directly from the primary pitot tube of the pitot pump. In such an embodiment the secondary pitot tube is merely deleted and a conventional pitot tube near the periphery of the casing is employed.

FIG. 3 is a fragmentary cross-section similar to FIG. 2 illustrating a jet pump in such an embodiment. In this arrangement a passage 154 extends from the pitot pump outlet passage 122 to the jet inlet 147 of the jet pump. The suction inlet 143 of the jet pump is connected to a tube 141 extending through the outlet passage 122 to an axial balancing chamber (not shown) analogous to the axial chamber 31 illustrated in FIG. 1. Thus, pressurized liquid from the main pitot pump outlet is directed to the jet pump for extracting fluid from the axial chamber and discharging it into the pitot pump inlet.

Figure 4:
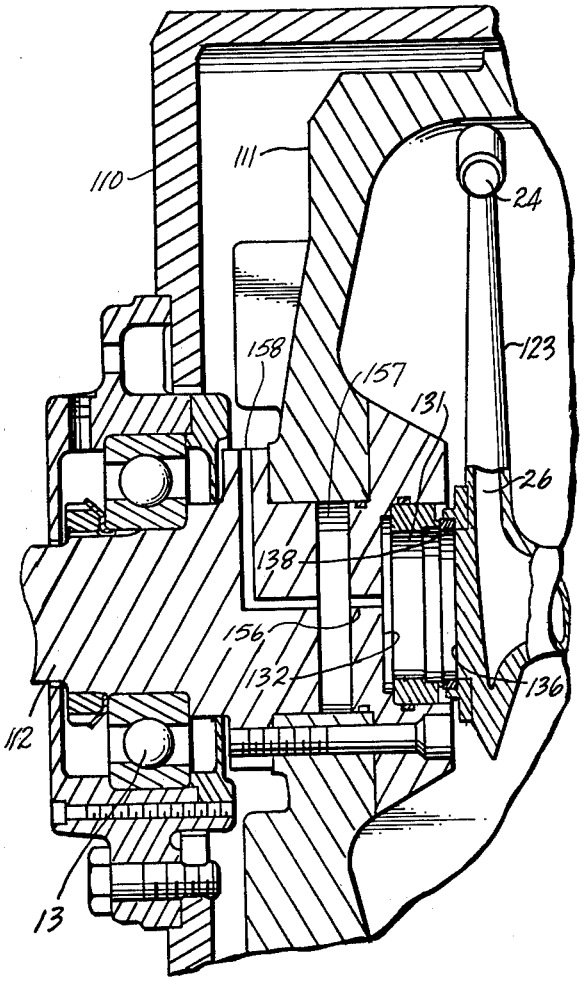
FIG. 4 is a fragmentary longitudinal cross section illustrating another embodiment.

FIG. 4 illustrates in fragmentary longitudinal cross-section another embodiment of thrust balanced pitot pump constructed according to principles of this invention. As illustrated in this embodiment there is a rotatable casing 111 mounted on a shaft 112 in a housing 110. A fixed pitot tube 123 is mounted in the rotary casing for withdrawing pumped fluid. In this embodiment there is not a secondary or auxiliary pitot tube as in the embodiment of FIG. 1. The balance of the pitot pump is essentially similar to that hereinabove described and illustrated in FIG. 1.

An axial balancing chamber 131 is formed between an end wall 132 of the casing and an end 136 of the pitot tube as in the previously described embodiment. A seal ring 138 minimizes leakage of fluid from within the casing into the axial chamber 131.

Pressure relief maintains the pressure in the axial chamber approximately at ambient. For this purpose a vent passage 156 leads from the axial chamber 131 to an open space 157 between the end wall of the rotary casing and the shaft 112. An angled vent passage 158 in the end of the shaft permits fluid to escape from the open space 157 into the interior of the housing 110. Typically the interior of the housing is substantially at ambient pressure. Some fluid leakage will occur past the seal 138 and accumulate in the housing. A pump (not shown) is therefore provided, preferably with a level control for intermittent operation, to reinject fluid from the housing into the pitot pump inlet. If desired, other disposition of the fluid leakage is feasible. Usually leakage into the housing is undesirable and the embodiment of FIGS. 1 and 2 is therefore preferred.

Although limited embodiments of single stage thrust balanced pitot pump for operation with a pressurized inlet fluid have been described and illustrated herein, many modifications and variations will be apparent to one skilled in the art. Thus, for example, instead of using a jet pump for withdrawing fluid from the axial balancing chamber and discharging it into the pitot pump inlet, other types of auxiliary pumps may be used for maintaining approximately ambient pressure in the axial chamber. A jet pump is particularly preferred since it operates without any additional power source or moving parts and operates quite well for maintaining a low pressure in the chamber even when there is almost no fluid flow therefrom due to there being a good seal between the interior of the casing and the balancing chamber. It is therefore to be understood that within the scope of the appended claims the invention may be practiced otherwise than as specifically described.

What is claimed is:

1. In a pitot pump having a casing, bearing means for mounting the casing for rotation, a fixed pitot tube in the casing for withdrawing pressurized fluid from within the casing and discharging the fluid through an axial outlet passage extending through one end wall of the casing, an annular inlet passage coaxial with the outlet passage for introducing fluid to the casing; balance means for minimizing axial thrust on the bearing means during operation of the pitot pump with pressurized inlet fluid, said balance means comprising:

a balancing chamber one portion of which is defined by an end wall of the casing opposite the end wall through which the inlet and outlet passages extend, the other portion of which is defined by an end of the pitot tube opposite the outlet passage;

rotary seal means for sealing the balancing chamber from within the casing;

a jet pump having a jet inlet, a suction inlet and an outlet;

feed means for applying pressurized fluid to the jet inlet of the jet pump;

a fluid conduit connecting the balancing chamber with the suction inlet of the jet pump; and means for discharging fluid from the jet pump outlet into the pitot pump inlet.

2. In a pitot pump as recited in claim 1, the improvement wherein the feed means comprises means for applying pressurized fluid from the fixed pitot tube to the jet inlet of the jet pump.

3. In a pitot pump as recited in claim 1, the further improvement wherein the feed means comprises a second fixed pitot tube in the casing having an opening at a radial distance from the axis of rotation of the casing less than the radial distance of the opening of the first pitot tube; and means for conveying pressurized fluid from the second pitot tube to the jet inlet of the jet pump.

4. In a pitot pump as recited in claim 3, the further improvement wherein the means for applying comprises a tube extending from the second pitot tube through the axial outlet passage of the first pitot tube and to the jet inlet of the jet pump.

5. In a pitot pump as recited in claim 1, further comprising a rotating seal between the rotatable casing and a stationary portion of the annular inlet passage for minimizing fluid leakage from the inlet passage, the improvement wherein the balancing chamber is coaxial with the casing and has a diameter approximately the same as the diameter of the rotating seal.

6. A pitot pump comprising:

a casing;

bearing means for mounting the casing for rotation;

an axial outlet passage extending through one end wall of the casing;

a fixed pitot tube in the casing for withdrawing pressurized fluid from within the casing and discharging the fluid through the outlet passage;

an annular inlet passage coaxial with the outlet passage for introducing fluid to the casing; and thrust balancing means for minimizing axial thrust on the bearing means during operation of the pitot pump with pressurized inlet fluid; said thrust balancing means comprising:

an axial chamber between an end wall of the casing opposite the end wall through which the passages extend and the pitot tube;

rotary seal means for sealing the chamber from fluid within the casing; and an auxiliary pump having an inlet connected to the axial chamber and an outlet connected to the pitot pump inlet for maintaining pressure in the axial chamber at approximately ambient pressure.

7. A pitot pump as recited in claim 6 wherein the auxiliary pump comprises a jet pump having a jet inlet, a suction inlet connected to the axial chamber and an outlet connected to the annular inlet passage; and further comprising feed means for applying pressurized fluid to the jet inlet of the jet pump.

8. In a pitot pump as recited in claim 7, the improvement wherein the feed means comprises means for applying pressurized fluid from the fixed pitot tube to the jet inlet of the jet pump.

9. In a pitot pump as recited in claim 8, the further improvement wherein the feed means comprises a second fixed pitot tube in the casing having an opening in the casing at a radial distance the axis of rotation of the casing less than the radial distance of the opening of the first pitot tube; and means for conveying pressurized fluid from the second pitot tube to the jet inlet of the jet pump.

10. In a jet pitot pump as recited in claim 9, the further improvement wherein the means for applying comprises a tube extending from the second pitot tube through the axial outlet passage of the first pitot tube and to the jet inlet of the jet pump.

* * * * *

UNITED STATES PATENT AND TRADEMARK OFFICE

CERTIFICATE OF CORRECTION

PATENT NO. : 4,183,713

DATED : January 15, 1980

INVENTOR(S) : John W. Erickson, Francis B. Brown

It is certified that error appears in the above-identified patent and that said Letters Patent are hereby corrected as shown below:

Column 6, line 41, "8" should be -- 7 --.

Signed and Sealed this

*Tenth* Day of *June 1980*

[SEAL]

*Attest:*

SIDNEY A. DIAMOND

*Attesting Officer*

*Commissioner of Patents and Trademarks*